US006987464B2

(12) United States Patent
Pearson

(10) Patent No.: US 6,987,464 B2
(45) Date of Patent: Jan. 17, 2006

(54) AUTOMATED TRAFFIC CONTROL SYSTEM HAVING AN INTERACTIVE EMERGENCY VEHICLE WARNING THEREIN

(76) Inventor: Jeremiah W. Pearson, 30261 Via Festivo, San Juan Capistrano, CA (US) 92675

( * ) Notice: Subject to any disclaimer, the term of this patent is extended or adjusted under 35 U.S.C. 154(b) by 154 days.

(21) Appl. No.: 10/741,891

(22) Filed: Dec. 19, 2003

(65) Prior Publication Data

US 2004/0145497 A1 Jul. 29, 2004

Related U.S. Application Data

(60) Provisional application No. 60/443,617, filed on Jan. 29, 2003.

(51) Int. Cl.
*G08G 1/00* (2006.01)

(52) U.S. Cl. ..... 340/902; 340/933; 200/19.17

(58) Field of Classification Search ..... 340/902, 340/906, 907, 917, 918, 933, 815.45; 200/19.17; 382/104; 116/63 R See application file for complete search history.

(56) References Cited

U.S. PATENT DOCUMENTS

| | | | | |
|---|---|---|---|---|
| 4,271,408 | A * | 6/1981 | Teshima et al. | 345/83 |
| 4,704,610 | A * | 11/1987 | Smith et al. | 340/906 |
| 2004/0008127 | A1 * | 1/2004 | Manavi et al. | 340/907 |
| 2005/0128104 | A1 * | 6/2005 | Karabinis | 340/933 |

* cited by examiner

*Primary Examiner*—Jeffery Hofsass
*Assistant Examiner*—George A. Bugg
(74) *Attorney, Agent, or Firm*—Mark C. Jacobs, Esq.

(57) ABSTRACT

A traffic priority defining system implemented by emergency vehicles at an intersection. A signal, designated the second electronic signal, post emanation, is electronically verified as to source and sent to the controller for a traffic control device, such as a tricolor traffic light, to override the primary signal operating the traffic light for opposing traffic. One of the colored lights, usually yellow, is actuated to a second operational mode, to display an icon of an emergency situation. The specified color light's incandescent bulb resumes normal full to yield a yellow glow at the proper time.

17 Claims, 3 Drawing Sheets

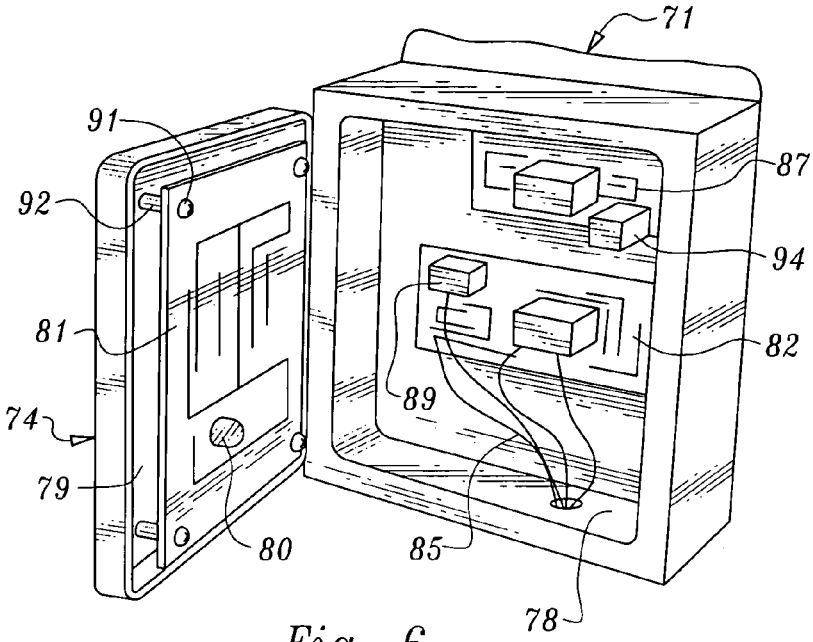
*Fig. 6*
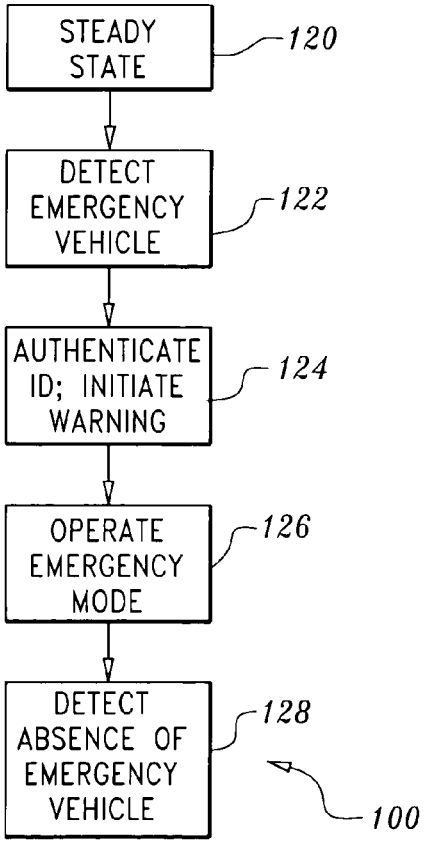
*Fig. 7*
| | | | | | | | | |
|---|---|---|---|---|---|---|---|---|
| Y | Y | Y | Y | B | Y | Y | Y | Y |
| Y | B | Y | B | Y | B | Y | B | Y |
| Y | Y | B | Y | Y | Y | B | Y | Y |
| Y | B | Y | Y | Y | Y | Y | B | Y |
| B | Y | Y | Y | Y | Y | Y | Y | B |
| Y | B | Y | Y | Y | Y | Y | B | Y |
| Y | Y | B | Y | Y | Y | B | Y | Y |
| Y | B | Y | B | Y | B | Y | B | Y |
| Y | Y | Y | Y | B | Y | Y | Y | Y |
*Fig. 8*

AUTOMATED TRAFFIC CONTROL SYSTEM HAVING AN INTERACTIVE EMERGENCY VEHICLE WARNING THEREIN

FIELD OF THE INVENTION

This application discloses and claims subject matter disclosed in my earlier filed provisional application, Ser. No. 60/443,617 filed Jan. 29, 2003.

BACKGROUND OF THE INVENTION

The present invention relates to a traffic control system and to an emergency vehicle warning apparatus included therein.

Emergency vehicles have a need to speed through intersections on their way to respond to situations. If the emergency vehicle on a main street is to avoid the necessity of having to slow down at every intersection to avoid colliding with vehicles when approaching from the intersecting streets, an effective warning must be provided of the presence of the emergency vehicle to such traffic on the intersecting streets.

Many prior art devices have been provided for this purpose. In many of these patented and unpatented devices a transmitter is included in the emergency vehicle to provide a signal. A receiver is located to detect the signal transmittal from the emergency vehicle. The receiver actuates a control circuit that activates a signal device.

Often the signal is an additional device built into or on the traffic light. Some systems also provide audio signals for pedestrians and vehicles. Others comprise rotary flashing lights. Still other systems trigger warning signals in devices that have been installed in nonemergency vehicles. These systems all require structure to be retro added either to vehicles or to the traffic light. This is both costly to a requirement to have new specially made traffic light fixtures which are not "off the shelf" increases the costs of such a signal system and decreases its likelihood of adoption by a municipal authority. Such systems also require custom transmitters for the emergency vehicles and receivers to cooperate with them.

There is a need therefore for a different way to solve the problem at minimal cost to the political entity thus this invention.

For a fuller understanding of the nature and objects of the invention, reference should be made to the following detailed description, taken in conjunction with the accompanying drawings.

SUMMARY OF THE INVENTION

It is a first object to provide a traffic vehicle control system which incorporates an emergency warning means which is readily integratable with existing traffic control systems.

It is a second object to provide a traffic control system that can be integrated into a transit vehicle priority system.

It is a third object to provide an effective emergency warning signal which maybe readily retrofitted into existing traffic light structures.

These and other objects of the invention will be set forth in detail herein and will be shown in the drawings as well as being set forth in the appended claims.

Briefly stated there is provided in the present invention, an emergency traffic vehicle warning apparatus defined within a traffic control system. As is known, emergency vehicles are equipped with AVI (automatic vehicle identification) transmitters, the presence of which may be detected by loop antennas, such as those included in transit priority systems. The receivers of the special signals from emergency vehicles communicate with an automatic controller that operates a traffic signal to the green for the emergency vehicle or red for traffic. The automatic controller is programmed to provide a second output signal to the traffic signal indicative of an emergency warning condition, when the signal is sent to operate the emergency warning signal.

The emergency warning signal of the present invention includes a two-state display. The display alternates between first and second states in response to the emergency signal. A first state may comprise a conventional traffic light display, namely, a colored circle of light. The second state may comprise a display of a specific symbol to depict an emergency situation. In a preferred form, the display comprises a matrix. The matrix is preferably included in a circuit package which may be disposed in a traffic light unit lamp socket to thereby provide for easy, low-cost retrofitting of conventional previously installed traffic signals.

BRIEF DESCRIPTION OF FIGURES

FIG. 6 is an isometric illustration of a warning signal retrofitted into a conventional traffic light.

FIG. 7 is a flow diagram illustrating operation of the present invention.

FIG. 8 is a signal light of a tricolor traffic signal having two different color LEDs therein.

DESCRIPTION OF THE PREFERRED EMBODIMENT

Figure 1:
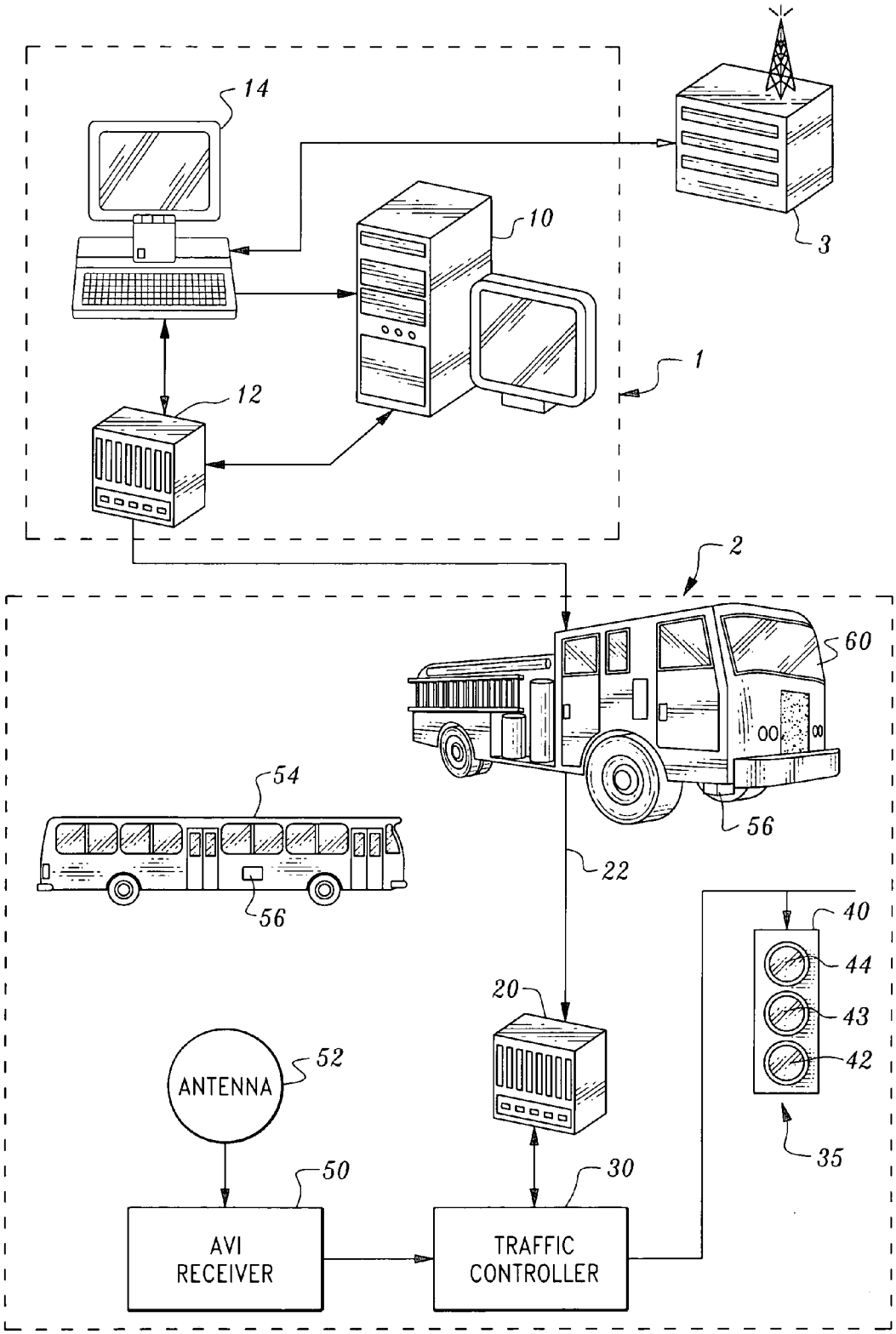
FIG. 1 is a block diagram that represents a traffic control system which incorporates the present invention.

FIG. 1 is a block diagram illustrating a transit control system which includes the present invention. An Automatic Traffic Surveillance And Control center (ATSAC center) 1 manages an Automated Traffic Control System (ATCS) referred to hereinafter as 2.

The ATCS 2 may be distributed over a city or other larger or smaller geopolitical region. The ATSAC center 1 may be coupled to and under the supervision of a control center 3. The control center 3 may comprise a Transit Authority Control Center, Department of Transportation or other control entity. An example of such a transit priority system is the transit priority system of the Los Angeles Department of Transportation. The ATSAC center 1 includes an ATCS server 10 which interacts with a central communications hub 12.

A Transit Priority Manager Server 14 may be supervised from the control center 3 and provided with such information as daily schedule updates. The transmit priority manager server 14 monitors compliance of particular buses with their schedules and provides particular priority requests via the central communications hub 12 to the ATCS system 2 as are needed to monitor schedules. The ATCS server 2 monitors bus priority established by the transmit priority manager server 14 and issue ATSAC control commands to the central communication hub 12.

An ATCS system, 2 comprises a plurality of field communication hubs 20. Each field communication hub 20 interacts with the central communication hub 12 via an ATSAC communications trunk 22. While only one is shown, the use of a plurality is contemplated. Each field communications hub 20 communicates with a traffic controller 30. Traffic controllers are well-known systems made by Siemens and Honeywell respectively, such as model 2070 or model 2170. The model 2070 utilizes VME hardware utilizing standard VME (Virtual Machine Environment) interface modules and off the shelf software provided by Microsoft. Programming and operation of the controllers is well known in the art. Each traffic controller 30 can control one or more traffic devices 35. In the present depiction, the traffic device 35 controlled is a conventional traffic signal light 40 comprising a green light 42, yellow light 43, and red light 44.

Each traffic controller 30 receives an input from at least one AVI (Automatic Vehicle Identification) receiver 50 which detects the presence of a vehicle by means of its loop antenna 52. The AVI receiver 50 and loop antenna 52 are as noted well-known devices. Commonly, the antenna loop 52 is placed in a ¼ inch wide long slot that has been sawn in a street and sealer is placed over the antenna to protect it. Commonly, the antenna 52 response to a signal from a bus 54 which has an AVI transmitter 56. The AVI transmitter 56 is also a well-known prior art device which automatically and continuously transmits a uniquely coded signal designated signal "A". The AVI transmitter 56 while normally installed on the underside of the vehicle in reality is shown here for simplicity on the side of the vehicle. In accordance with the present invention, an emergency vehicle 60, in the present exemplification, a fire engine 60, is provided with an AVI transmitter 56. The transmitter 56 is provided with a code that is programmed in the ATCS server 10. The transmitter from the emergency vehicle put forth a signal "B" when needed.

Figure 2:
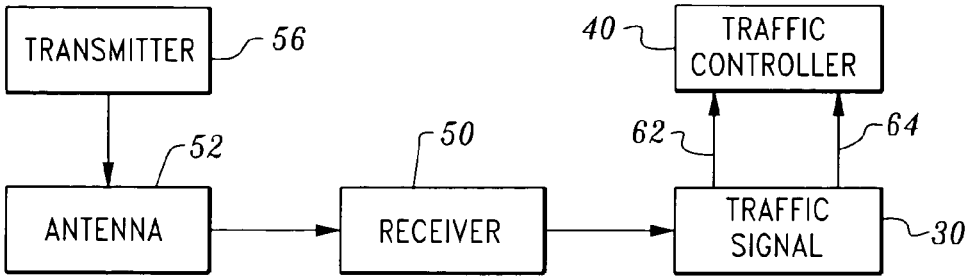
FIG. 2 is a block diagram illustrating the connection of the traffic system controller to the emergency warning signal circuit.

FIG. 2 is a block diagram which depicts the interaction of the emergency vehicle 60 and the traffic control system 2 to operate the traffic light 40 and other similar devices 35 when an emergency arises. Approach of the transmitter 56 of the emergency vehicle 60 putting forth signal "B" is sensed by the antenna 52, which provides an input signal to the receiver 50. The traffic controller 30 decodes the identity of the emergency vehicle 60 and communicates with the field communications hub 20 to determine if the code transmitted by the transmitter 56 is an authorized emergency signal "B". In the normal state, the traffic controller 30 provides a first output indicated as being on a line 62 to operate the traffic signal 40 in its normal green-yellow-red mode as may be conventionally modified by signals received by bus 54. When the traffic controller 30 senses an emergency vehicle 60, different output, illustrated as being on a line 64, is transmitted to the traffic signal 40 to provide emergency mod operation as further described below. The illustration set forth in FIG. 2 is for the purposes of describing operation or the system. It is possible that lines 62 and 64 in some embodiments will not be separate signals.

Figure 3:
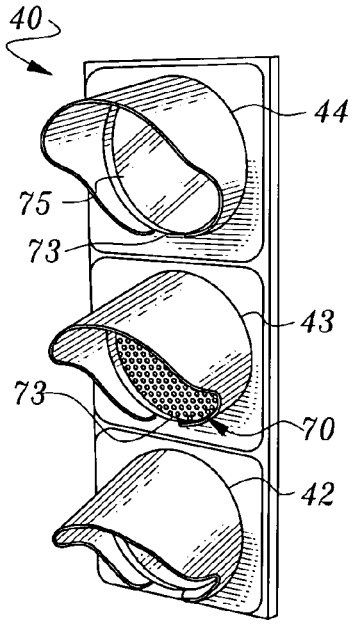
FIG. 3 is an illustration of the emergency warning display disposed within a traffic light.

FIG. 3 is an illustration of a typical traffic signal but modified as noted. In FIG. 3, a first version of a state of an emergency display is shown for one color of the traffic light, which is to be solely illuminated. In the preferred arrangement, this would be yellow light 43.

Figure 4:
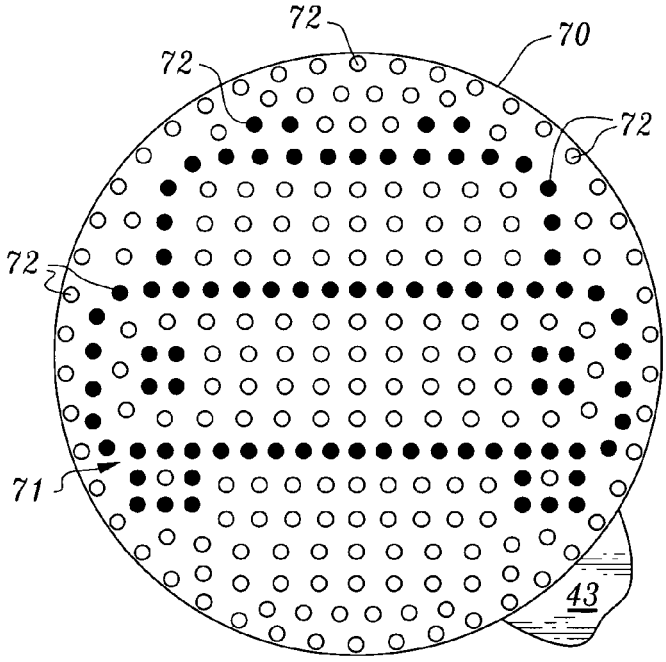
FIG. 4 illustrates a traffic light matrix energized into a second state.

FIG. 4 is an illustration of the traffic light 43 of FIG. 3 embodied as a matrix of LEDs. An LED is a light-emitting diode. Normally traffic lights use a single white light that emits its light through a specifically colored lens or optimally a colored bulb or red, yellow or green can be used with a clear lens.

Here, the matrix includes a large plurality of several hundred individual diodes behind a clear glass or polycarbonate lens. In normal operation, all or almost all of the yellow light-emitting diodes are operative for a signal "A" that transpires during normal nonemergency operation.

Figure 5:
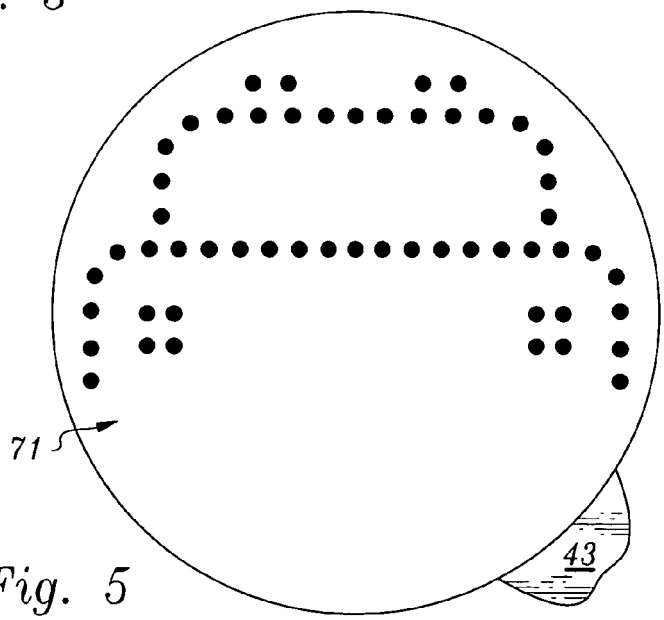
FIG. 5 illustrates the pattern displayed to drivers by the grid of FIG. 4.

In a second version, as illustrated in FIG. 4, the light 43 displays an emergency symbol 71. In order to conveniently provide the display, the yellow light 43 comprises a matrix 70 of specific individual yellow light-emitting diodes 72. The light-emitting diodes 72 are arranged to have an outline approximating that of a circle in order to provide the yellow light display as illustrated in FIG. 3. But upon the occurrence of an emergency, selected light-emitting diodes 72 are illuminated at the same time to provide a display of an emergency symbol 71. In the embodiment as illustrated in FIG. 4, the symbol indicative of an emergency signal is an icon representing an emergency vehicle. Other symbols can be used as may be desired. In a preferred form, the display alternates periodically between a first state and a second state, i.e., between a traffic color display and the emergency symbol 71 display. The emergency symbol 71 generated by the matrix 70 of "ON" LEDs 72 is illustrated in FIG. 5.

In the alternative, if desired, a different color of light could be emitted by the selected diodes. For example, blue light diodes that remain nonactivated during normal operation of the yellow signal light could be employed. When the emergency occurs, the yellow full circle can alternate with the blue icon lights or the yellow can terminate and only the blue icon signal can be seen as a steady or flashing light as may be desired. Such choices are within the skill and judgment of the political entity.

As noted further in FIG. 3, which is one form of the present invention, the green and red lights 42 and 44 comprise conventional single lamps, each behind a lens 75 in an aperture 73. The yellow light 43 comprises the matrix 70 retrofitted into the traffic light 40. FIG. 6 is a detailed partial view of FIG. 3 illustrating one compartment 78 having a cover 79 containing the yellow light 43. The warning light assembly 80 of the present invention embodied in the yellow light 43 comprises a circuit board 81 and operational circuitry 82. The circuit board 81 contains the matrix 70. The circuit board 81 is coupled to the operations control circuit 82 via a cable assembly 85, comprising a plurality of cables in a harness.

The cable assembly 85 carries both power and addressing information to light the appropriate preselected light-emitting diodes 72. The control circuit 82 may include power conversion circuitry 87 to take power previously designated for a lamp and use it to operate the control circuit 82 and matrix 72. The control circuit 82 also includes a decoder 89 for interpreting the output of the traffic controller 30; see FIG. 1, to operate the matrix 72, either in full or under signal B in the icon format.

While the discussion has set forth the incorporation of the matrix of LEDs into the yellow traffic lamp opening, obviously the red or the green could be just as easily utilized instead.

It is also to be seen that a different icon other than the car shown in FIG. 5 can be used as the emergency signal this symbol such as a five or six pointed star, an ambulance, fire engine, police car or even a red cross specifically for the red signal light could be used as alternate icons.

In order to ensure geopolitical acceptance of this invention, especially during times such as the early 21st century when municipalities are strapped for cash for all but necessities, it is important to be able to retrofit this invention into existing traffic devices, as opposed to trying to persuade governing bodies to purchase new equipment.

In order to retrofit the traffic light 40 with the warning indicator apparatus of the present invention, the lamp illuminating the yellow light 43 and its corresponding lens 75 are removed from the traffic light 40. See FIG. 3. The circuit board 81 is mounted to the rear of the cover 79 central compartment closure 74 so that the matrix 70 is in registration with the aperture 73. A fastener 91 seen in FIG. 6 projects through the circuit board 80 to support the circuit board to a standoff 92, at each corner of the circuit board 80. In this manner, the circuit board 80 is supported to area surface of the central lighting component closure 74. The control circuit 82 is mounted in the central lamp chamber 71. As illustrated in FIG. 6, the control circuit 82 includes a fixture 94 to mount the control circuit 82 adjacent the area where a socket—not seen, would receive a lamp in a conventional embodiment is located. The matrix of LEDs 70 is seen in FIG. 3, but from the perspective of FIG. 6.

The present invention thus provides convenient, cost-effective retrofit product to produce a new interactive system. The traffic light assembly 35 may be conveniently retrofitted as described above at reasonable cost. Emergency vehicle 60 may be conveniently fitted with AVI transmitters 56. The ATS server at the central ATSAC center 1 may conveniently program each field communications hub 20 and local traffic controller 30. Other variations and modifications are within the skill of the artisan. It is readily seen that the chosen light can just as easily be the red or green to be modified to include the matrix of this invention to display the icon of an emergency situation as may be desired.

FIG. 7 is a flow chart which illustrates the operation of the present invention, 100. At block 120, the steady state operation is performed. Steady state operation includes normal operation of the ATSC 2 including operation of the traffic light and the granting of transit bus priority as discussed. At block 122, an emergency vehicle 60 is detected by the AVI receiver 50. At block 124, the traffic controller 30 authenticates the identification of the emergency vehicle 60, again per FIG. 1, and initiates an emergency warning. At block 126, the emergency warning system, when in the present embodiment, is the yellow light 43, is operated in emergency mode per the discussion of FIGS. 4 and 5. At block 128, the current absence of an emergency vehicle is detected since the fire truck has moved through the specific invention and where the operation of the signal light returns to the steady state.

The emergency warning indicator of the present invention may also be provided independently of an ATSC system 2. Indeed there will be intersections where provision of emergency warning in accordance with the present invention will be highly useful but which intersections are not on transmitting routes. Here, the transmitter 56 and receiver 50 shown in FIG. 2 need not necessarily be an AVI transmitter and receiver that sense a signal from an antenna. Other known forms of transmitter and receiver may be used, such as a direct wired connection to change the matrix of a traffic signal 35 positioned adjacent a firehouse to the icon position as the fire truck departs the firehouse. The present invention may be used in other traffic control lights not included in a traffic control system. With the ease of retrofit in a traffic light housing and with the convenience in programming of widely used, conventional traffic controllers, the present invention can be cost-effectively deployed.

Any means can be utilized for the implementation of the second signal. Mention may be made of rocker switches, slide switches, toggles and push buttons. The signals can be adjusted to work only close to the intersection, such as at 500 feet away from the controller, or for rural areas, it can be adjusted to work at about one half mile away.

While the discussion has focused on the changing of the display of the matrix from a full circle glow, to the symbol of an icon indicative of an emergency, it is also to be seen that the second state of display can arise from the termination of a first color plurality of LEDs and the illumination of a second smaller plurality of LEDs within the same matrix. For example the majority of LEDs are yellow, with but a small amount being blue. When the second state is to transpire the yellow turns off and the blue turns on, all within the same light. See FIG. 8 wherein the Yellow glowing LEDs are designated "Y" and the blue glowing ones designated "B"

It is also to be noted from FIG. 8 that the light of a signal need not be the customary round but can be a square of chamfered corner square as may be desired. Therefore the term full circle glow is used loosely and is not intended to specific denote a circular shape.

While the discussion has centered on traffic tricolor lights, the invention also has applicability to combination semaphores and lights at railroad crossings and other traffic control devices.

Since certain changes maybe made in the described apparatus without departing from the scope of the invention herein involved, it is intended that all matter contained in the above description and shown in the accompanying drawings shall be interpreted as illustrative and not in a limiting sense.

I claim:

1. A traffic priority defining system for implementation by an emergency vehicle as it approaches an intersection of opposing traffic, which system comprises:

means for sending a special signal from an emergency vehicle to a means for confirmation that the signal has emanated from a legitimate emergency vehicle, means for forwarding the special signal post confirmation to the controller of a tricolor light traffic control device in the vicinity of the emergency vehicle, a loop antenna on the controller of the traffic control device to receive the special signal, means in the controller to generate a second signal indicative of an emergency to override a general signal from the controller of the traffic control device, to cause one of the lights of the traffic control device to switch from a full circle glow to the depiction of an icon associated with an emergency situation, wherein the icon is selected from the group consisting of a fire engine, a multi-pointed star, a police car, an ambulance and a red cross.

2. The traffic priority defining system of claim 1 wherein the means for sending the special signal is an AVI (automatic vehicle identification transmitter).

3. A traffic priority defining system for implementation by an emergency vehicle as it approaches an intersection of opposing traffic, which system comprises:

means for sending a special signal from an emergency vehicle to a means for confirmation that the signal has emanated from a legitimate emergency vehicle, means for forwarding the special signal post confirmation to the controller of a tricolor light traffic control device in the vicinity of the emergency vehicle, a loop antenna on the controller of the traffic control device to receive the special signal, means in the controller to generate a second signal indicative of an emergency to override a general signal from the controller of the traffic control device, means mounted in the traffic control device to receive the second signal, associated with one of the lights of said traffic control device, whereby the specific one of the lights of the traffic control device changes from a full circle glow to the depiction of an icon associated with an emergency situation upon receipt of the second signal, wherein the icon is selected from the group consisting of a fire engine, a multi-pointed star, a police car, an ambulance and a red cross.

4. The traffic priority defining system of claim 3 the means for receiving the second signal is mounted within the area of one of the lights of the traffic control device.

5. The traffic priority defining system of claim 4 wherein the specific one of the lights having the second signal receiving means comprises a switchable matrix of light-emitting diodes.

6. The traffic priority defining system of claim 5 wherein the switchable matrix of light-emitting diodes is the yellow light.

7. The process of controlling traffic priority for an emergency vehicle comprising:

[a] transmitting a special signal from an emergency vehicle,

[b] receiving the signal at a receiver,

[c] confirming the veracity of the source of the signal as an emergency vehicle,

[d] providing a signal to a traffic controller that electronically controls a tricolor traffic signal with a first signal,

[e] sending a second signal from the traffic controller to the tricolor light signal to change the display of one of the lights of said signal to a depiction of an icon associated with an emergency situation, wherein the icon is selected from the group consisting of a fire engine, a multi-pointed star, a police car, an ambulance and a red cross.

8. The process of controlling traffic priority for an emergency vehicle of claim 7 including the further step of detecting the absence of the emergency vehicle.

9. The process of claim 7 wherein the display changes from a full display glow to the depiction of an icon associated with an emergency.

10. The process of controlling traffic to permit the smooth passage of emergency vehicles without interruption, which comprises:

[a] operating a traffic control device at a steady state,

[b] detecting the presence of an emergency vehicle in the vicinity of the traffic control device from a special signal emitted from the emergency vehicle,

[c] authenticating the veracity of the emergency vehicle,

[d] initiate a signal responsive thereto to the traffic control device to operate the traffic control device in a second state indicating the existence of an emergency,

[e] detecting the passage of the emergency vehicle from the vicinity of the traffic control device and returning the operation of the traffic control device to its steady state.

11. The process of claim 10, wherein the traffic control device is a tricolor traffic light, and wherein the second state of operation is the display of an icon indicative of an emergency in one of said lights.

12. The process of claim 11 wherein the display of the icon is in a different color LED from the normal color of the light's LEDs during nonemergency indication operation.

13. A light signal for a tricolor traffic signal comprising, a switchable matrix of light-emitting diodes switchable from a first mode of a specific color to the display of an icon indicating the presence of an emergency vehicle, upon the input of a signal for said purpose.

14. A lens bearing light signal for a tricolor traffic signal comprising a circuit board mountable to the cover of a light compartment of a traffic signal, an LED matrix mounted on said circuit board, such that the emitted light therefrom is visible through the lens of the light of the signal, and a control circuit also disposed within said compartment and an antenna connected to said controller, wherein the visible emitted light is an icon associated with an emergency situation, and is selected from the group consisting of a fire engine, a multi-pointed star, a police car, an ambulance and a red cross.

15. The light signal as in claim 14 further including standoffs to mount and to correctly position said matrix and said controller.

16. The traffic priority defining system of claim 9, wherein the icon is selected from the group consisting of a fire engine, a multi-pointed star, a police car, an ambulance and a red cross.

17. The full display glow of claim 9, wherein the display is a circular display.

* * * * *